United States Patent [19]

Scesney

[11] Patent Number: 5,047,743

[45] Date of Patent: Sep. 10, 1991

[54] INTEGRATED MAGNETIC ELEMENT

[76] Inventor: Stanley P. Scesney, P.O. Box 101, Camarillo, Calif. 93010

[21] Appl. No.: 329,686

[22] Filed: Mar. 28, 1989

Related U.S. Application Data

[63] Continuation-in-part of Ser. No. 146,843, Jan. 22, 1988, abandoned, which is a continuation-in-part of Ser. No. 799,260, Nov. 18, 1985, abandoned.

[51] Int. Cl.[5] ..... H01F 7/02

[52] U.S. Cl. ..... 335/302; 79/607; 335/306

[58] Field of Search ..... 335/296, 302, 303, 306

[56] References Cited

U.S. PATENT DOCUMENTS

| | | | |
|---|---|---|---|
| 3,257,586 | 6/1966 | Steingroever | 335/303 |
| 3,784,945 | 1/1974 | Baermann | 335/302 |
| 4,110,718 | 8/1978 | Odor et al. | 335/296 |
| 4,383,193 | 5/1983 | Tomite et al. | 335/302 X |
| 4,544,904 | 10/1985 | Tarachand | 335/303 X |
| 4,687,608 | 8/1987 | Eino | 335/302 X |

FOREIGN PATENT DOCUMENTS

| | | | |
|---|---|---|---|
| 2428307 | 2/1980 | France | 335/302 |

*Primary Examiner*—George Harris

*Attorney, Agent, or Firm*—Cislo & Thomas

[57] ABSTRACT

An integrated magnetic element is provided, which comprises at least two magnetic elements of dissimilar materials. The integrated magnetic element is subjected to the same magnetomotive force, in order to induce the same magnetization in each element. The resulting integrated magnetic element will have a force of attraction or repulsion greater than that of a magnet comprising only one magnetic element and thus will do more useful work when incorporated into a magnetic device such as a solenoid, relay, rotor of a motor, or memory device.

3 Claims, 3 Drawing Sheets

Fig. 1.
(PRIOR ART)
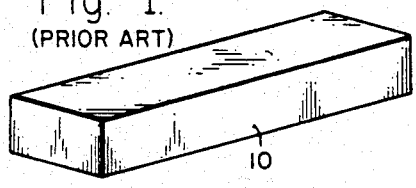
Fig. 2.
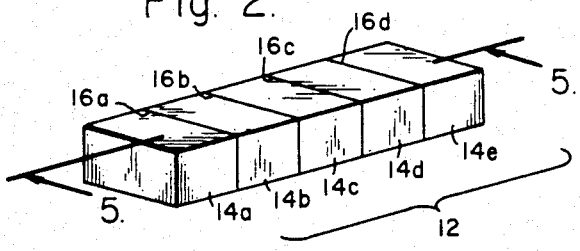
Fig. 3.
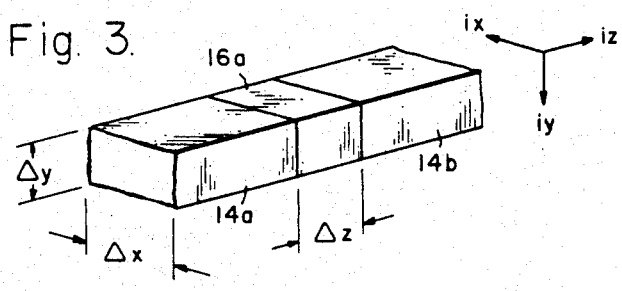
Fig. 4.
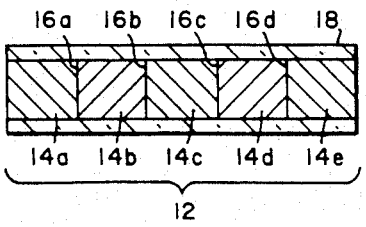
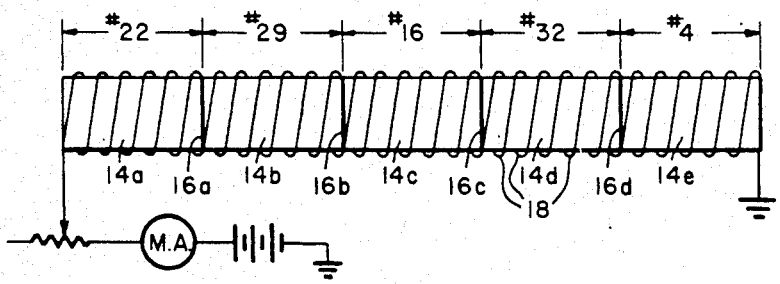
Fig. 5.
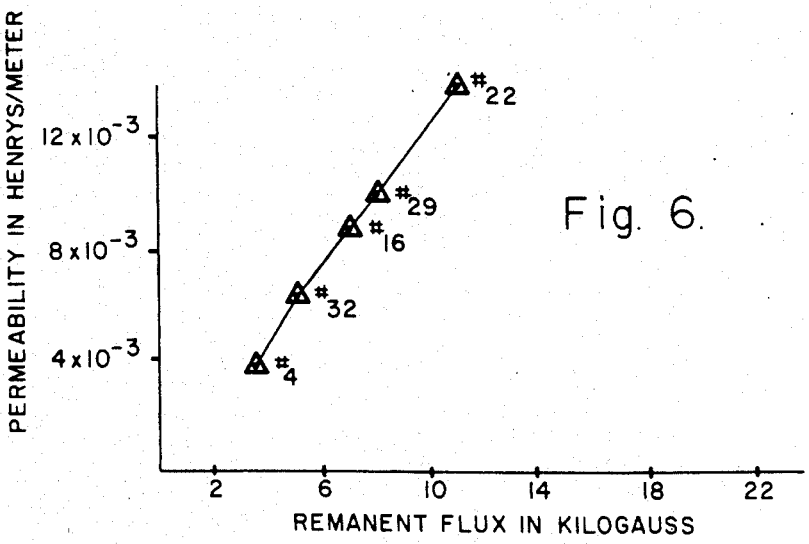
Fig. 6.

INTEGRATED MAGNETIC ELEMENT

BACKGROUND OF THE INVENTION

This invention relates to magnetic elements, and, more particularly, to a new integrated magnetic element comprising a plurality of materials having different magnetic permeabilities joined together.

This application is a continuation-in-part of Ser. No. 07/146,843, filed on Jan. 22, 1988, which is a continuation of an earlier filed application, Ser. No. 799,260, filed on Nov. 18, 1985 now abandoned, with the same title.

The use of magnetic devices such as relays, solenoids and motors comprising rotors and stators, is well-known. Such devices comprise a magnetic element upon which a magnetic field acts, either by means of another magnet or by means of an associated electricial circuit which induces a magnetomotive force in the magnetic element.

The work available in a magnetic circuit is directly proportional to the permeability of the magnetic material employed in the magnetic circuit. Consequently, efforts are continually being made to develop materials having higher and higher permeabilities, in order to perform useful work and to switch faster.

The single piece of iron or steel possesses a characteristic called a hysteresis loop and the energy ($W_m$) stored in (at a discrete point) it is defined as one half the flux density (B) squared divided by the permeability ($\mu$) of the sample:

$$W_m = \frac{1}{2}\,\frac{B^2}{\mu}\ \text{(joules/meter}^3\text{)}$$

$$= \frac{1}{2}\int_{\text{vol}} H^2 dv$$

In a steady magnetic field, the energy stored is $$W_m = \tfrac{1}{2}\int_{\text{vol}} H^2 dv$$

The inductance (L) of such a single piece of magnet from an energy standpoint can also be defined as $$L = 2W_m/I^2$$

where I is the total current flowing in a closed path and $W_m$ is approximately the energy in the magnetic field produced by this current. Classically, inductance is the ratio of the change in flux to the change in current in the system that the energy is stored in.

By definition, the voltage induced by changing flux ($\phi$) is equivalent to the inductance times the changing current (i) with respect to time.

$$\text{or } \frac{Nd\phi}{dt} \simeq \frac{Ldi}{dt}$$

$$\text{and } L \simeq \frac{\frac{d\phi}{dt}}{\frac{di}{dt}} \simeq \frac{d\phi}{di}$$

Processing of all of these classical equations has been done and can be found in any good field engineering text.

Classically, the ratio of $\Delta\phi/\Delta i$ changes as the number of ampere turns changes and as is relevant the inductance of the selected magnetic material (hard or soft) varies as a function of the ampere turns or magnetomotive force presented to the sample; the inductance starts from some maximum and is reduced to some minimum as the number of ampere turns changes.

Forces attractive or repulsive exerted by the selected magnetic materials (hard or soft) are described by equations such as:

$$F \simeq \frac{B^2 A}{2\,\mu_o}\ \text{(newtons)}$$

which is the classical equation for the attraction of two pole pieces separated by an air gap.

In each case, the flux ($\phi$) is equivalent to the flux density in, for example, webers per square meter times square meters; or $\phi = BA$ specifically to illustrate the fact that this flux is essentially constant across the cross sectional area (A) of the sample, where the density in a homogeneous sample of the selected material is typically constant.

Subjecting such the selected magnetic material (hard or soft) to magnetomotive forces always results in one discrete point of permeability or $\Delta\phi/\Delta i$ (inductance) at any particular point in time:

$$\text{or } \phi = f(mmf) \text{ or } f(NI)$$

$$\text{and } L = f\left(\frac{\Delta\phi}{\Delta i}\right) \text{or } \frac{\Delta\phi}{mmf}$$

and the inductance or permeance is limited to a small domain of values attributable to that particular sample of the selected magnetic material subjected to such a variance in magnetomotive force or ampere turns as a function, of course, of a particular or discrete point in time.

As to the stated resulting energy product, Applicant states that the conclusion was based upon the increase of the manifested magnetic force. A computer-selected material should of course be chosen.

A selection of any one of these materials to use as a bar magnet would limit its inductance, the available force and, of course, the maximum amount of energy that could be stored in the selected material, as a function of the magnetomotive force applied to the selected material. These forementioned statements all apply to any material classified as one being in the ferromagnetic class.

OBJECTS AND SUMMARY OF THE INVENTION

It is an object of the present invention to provide an integrated magnetic element having magnetic permeabilities higher than heretofore attained.

It is a further object of the present invention to provide an integrated magnetic element which may be used in a variety of magnetic circuits.

It is yet another object of the present invention to provide an integrated magnetic element for use in various magnetic circuits which improves the work output of such circuits.

It is still another object of the present invention to provide a process for fabricating an integrated magnetic element for use in various magnetic circuits.

It is an important and specific object of the present invention to provide a motor incorporating at least one integrated magnetic element.

It is another important and specific object of the present invention to provide a magnetic memory element incorporating an integrated magnetic element therein.

These and further objects of the present invention will become apparent upon a consideration of the drawing taken in conjunction with the following commentary.

Briefly, an integrated magnetic element is provided which comprises at least two materials of dissimilar permeability fused together by laser beam or Leliarc or other fusion process. Each material comprising the integrated magnetic element is subjected to the same magnetomotive force.

The resulting combination has a force of attraction or repulsion greater than that of a magnetic element of any one of the materials alone. Consequently, use of the integrated magnetic element of the invention in a magnetic device will result in a greater work output and faster switching than provided by a conventional magnetic element.

BRIEF DESCRIPTION OF THE DRAWING

FIG. 1 is a perspective view of a prior art magnetic element, comprising a single material;

FIG. 2 is a perspective view of the integrated magnetic element of the invention, comprising a plurality of discrete magnetic materials of different permeabilities fused together;

FIG. 3 is a perspective view of an enlarged portion of FIG. 2, showing the junction between two elements of dissimilar permeability;

FIG. 4 is a side elevational view of the integrated magnetic element of the invention, depicting a series of windings about each element, which are connected to a circuit for inducing an identical magnetomotive force in each element;

FIG. 5 is a cross-sectional view of the integrated magnetic element of FIG. 2, taken along the line 5—5, showing the element encased in a diamagnetic material;

FIG. 6 is a graph, plotting the permeabilities ($\mu$) in Henrys/meter of several magnetic materials as a function of the remanent flux ($B_g$) in kilogauss

DETAILED DESCRIPTION OF THE PREFERRED EMBODIMENTS

Figure 7:
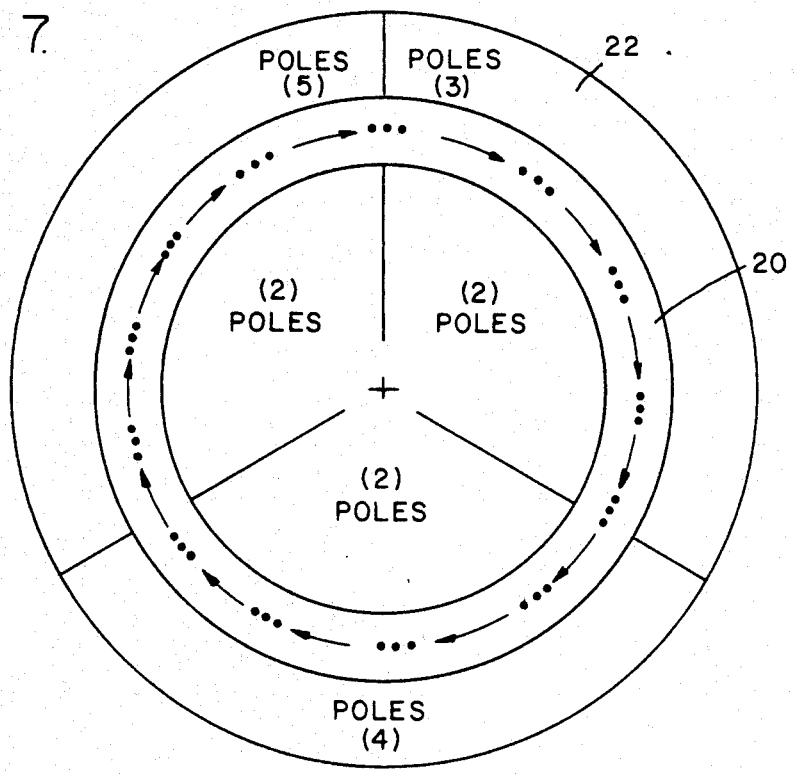
FIG. 7 is a schematic view, depicting a rotor and stator combination, employing integrated magnetic elements of the invention.

Referring now to the drawing, wherein like numerals of reference refer to like elements throughout, a prior art magnetic element is depicted in FIG. 1 and designated as 10. This material, which is shown in bar form, may be in a variety of forms, as is well-known in the art, and may be employed in devices such as solenoids, relays, motors comprising rotors and stators and toroidal memory elements for digital computers.

The integrated magnetic element (hard or soft magnetic materials) of the invention is depicted schematically in FIG. 2 generally at 12, comprising a plurality of discrete magnetic components, or elements, 14*a*, 14*b*, etc., separated by a junction 16*a*, 16*b*, etc., respectively. Each discrete component has its own permeability. Materials having permeabilities as low as about 250 to as high as 1,000,000 or more may be employed in the practice of the invention. The permeabilities as discussed herein are the relative permeabilities, that is, the permeability of the material relative to that of air. As is well-known, the permeability of a magnetizable substance is the degree to which it modifies the magnetic flux in the region occupied by the magnetizable substance in a magnetic field.

Referring now to FIG. 3, an enlarged portion of FIG. 2 is depicted, showing the junction 16*a* between two elements 14*a* and 14*b*. The junction has a width given by z; the dimensions of the portion of the two elements depicted are given by $\Delta x$ and $\Delta y$.

At finite intervals, it can be shown that $$\nabla \cdot B = \frac{\Delta B_x}{\Delta x} + \frac{\Delta B_y}{\Delta y} + \frac{\Delta B_z}{\Delta z}$$

In ferromagnetic materials, the applied magnetomotive force (mmf) determines the flux density in the affected material.

$$\nabla \cdot B \simeq \frac{\Delta(\mu H_x)}{\Delta x} + \frac{\Delta(\mu H_y)}{\Delta y} + \frac{\Delta(\mu H_z)}{\Delta z}$$

If the applied (mmf) is a direct current on the surface on the material in the form of current elements ($i_x + i_y$) etc., as would be applied by a winding of N turns, a discrete permeability would be obtained in each of the above sections 14*a* and 14*b* of FIG. 3.

The integrated magnetic element of the invention is an integration of ferromagnetic materials which cover the whole span of permeability and which are designated as being in that class whose permeabilities ($u_n$) range in span from about 250 to 1,000,000 and integrated in the manner as illustrated in FIG. 2.

Establishment of a selected point of (mmf) on each (hard or soft) magnetic material selected as in FIG. 2 by winding on each element selected the same number of ampere turns will establish an integrated elemental magnetic element which will in turn establish a series of forces, inductances and energy quanta not found in a magnet of any one of the materials, assuming, of course, that the windings are in series and connected to the same source.

Thus, $$L_T \simeq \frac{\Delta\phi_T}{\Delta i} \simeq \frac{1}{\Delta i}(\Delta\phi_1 + \Delta\phi_2 + \ldots + \Delta\phi_n)$$

$$F_T \simeq \frac{\mu^2 H^2 A}{\mu_o} \simeq \frac{A}{\mu_o}(\mu_1^2 + \mu_2^2 + \ldots + \mu_n^2)\, H^2$$

$$\simeq F_1 + F_2 + \ldots F_n \text{ (vector sum)}$$

In short, this integration has in effect increased the total resultant force of the integrated magnetic element, as opposed to an element of the same size of one single material or magnet, and which now has more energy, more force and more inductance than the magnet. Thus, (n) domains have been established where each domain has the same (mmf), but a different vector force and a different flux density.

The integrated magnetic element depicted in FIG. 2 will have a force of attraction or of repulsion greater than the prior art magnet depicted in FIG. 1, since the resultant force of attraction or repulsion is only a function of flux area and permeability of the material and not length.

Having established the materials and classified them as (hard or soft) ferromagnetic materials and integrated them together in some permanently fused element, the (mmf) required can then be selected and this value can be established in all of the integrated materials to build the integrated magnetic element of the invention an element which by its very structure can easily withstand steel mill thermal and mechanical forces.

Establishing the (mmf) in the integrated magnetic element of the invention is accomplished by winding the entire element such that each element is exposed to the same field. For example, employing five elements 14*a–e*, each having a length of 1.5 to 2.5 cm, then winding each element with 100 turns of wire 18 and introducing a current of 39.8 milliamps in the wire, as shown in FIG. 4, will result in an (mmf) of about 79.6 ampere turns/m, or 1 oersted.

Having built such an element, it may be spun in an orbit with a coil of wire to establish the [Nd$\phi$/dt] of the integrated system. For example, one weber/meter$^2$/sec will generate one volt in a coil of wire.

Spinning such a reference coil in the domain of the flux of the integrated magnetic element will establish its reference flux. Comparing the reference flux of each of the (N) magnetic elements will establish the (mmf) of each of them to ensure that they are identical with respect to each other.

A balancing bridge, such as a Wheatstone bridge, and associated circuitry is employed to compare each element to another to ensure that each element has the same precise magnetic potential. This is important, since it is known that two permanent magnets having the same energy product will not reverse each other.

Any integrated magnetic element not exactly equal to any other would be subjected once again to an additional (mmf) such that all integrated magnetic elements have the same precise magnetic potential.

Having followed such a procedure, many integrated magnetic elements having the same selected potential may be built, and these elements may be fabricated into any desired geometrical configuration to do useful work.

As an example, the elements of the invention may be used in solenoids or relay armatures or in computer memory and other magnetic circuits where faster switching is desired.

Comparing this integrated magnetic element with an ordinary magnet it is seen that a fused integration of these (hard and soft) magnetic materials has been constructed.

Thus, an integrated material has been established which has different currents in different domains and different flux in different domains.

Incorporation of these integrated magnetic elements into a rotating device with an unbalanced system will do useful work, where the number of poles in the rotor are less than the number of poles in the stator.

The gap force between integrated magnetic elements of the same polarity and which are equal in magnetic potential is given by $$F_{(gap)}=\mu^2H^2A/2\mu_o \text{ or } \phi^2/2A\mu 0$$

This force is a function of area and the (mmf). Integration of these elements with different areas into an unbalanced system will cause rotation; since the integrated magnetic element has gap forces much greater than an ordinary magnet, it will do much more work than an ordinary magnet.

It should be mentioned that since these elements have a wide range of permeabilities, the flux paths will be constrained to remain within their prescribed domain. Encasing each element with materials that have negative susceptabilities will oppose any leakage from any single magnet in the element, as depicted in FIG. 5. There, the integrated magnetic element 12 of the invention is encased with a diamagnetic material 18.

By definition, $$\mu=\mu_o(1+M/H)$$

where the ratio (M/H) is called the magnetic susceptibility; diamagnetic materials have relative permeabilities less than 1. Surrounding these integrated magnetic elements with diamagnetic materials will further constrain the lines of flux to the material and free space.

Examining the integrated magnetic element again, it can be seen that since the flux density changes across the element as a function of its distance from an arbitrary reference, it has a special characteristic at the junctions 16*a–d* of the various materials. As an example, divergence of a function (arbitrary) is defined mathematically as:

$$div\ F = \left(\frac{\partial F_x}{\partial x} + \frac{\partial F_y}{\partial y} + \frac{\partial F_z}{\partial z}\right)$$

Looking at the element, there is a change in the divergence of the magnetic element at the juncture of two materials whose permeability varies over a large range. For example, at material 14*a*, div B=0, and at material 14*b*, div B=0. However, at the junction 16*a*, div B$\neq$0, because there is a change in the flux density of the integrated magnetic element, which was put in there when the integrated magnetic element was manufactured.

Even the curl will change at the junction 16*a*, curl being defined as $\Delta$XB $$\nabla XB = i\left(\frac{\partial B_z}{\partial y} - \frac{\partial B_y}{\partial z}\right) + j\left(\frac{\partial B_x}{\partial z} - \frac{\partial B_z}{\partial x}\right) + k\left(\frac{\partial B_y}{\partial x} - \frac{\partial B_x}{\partial y}\right)$$

It is clear that the flux density will change at the junction. The measure of it may be difficult, but there is no question that these flux patterns will change at the interfaces, and application of potential points through dielectric interfaces at these junctions or any place along these integrated magnetics elements will affect the curl and divergence patterns even more.

From another standpoint, since permeance is defined as some constant times the permeability, or the reciprocal of reluctance, and element has been constructed whose magnetic potential is a function of reluctance (R) and magnetic flux through the magnetic element.

$$\mu=(R)(\phi_m)$$

Integration of quanta such as magnetic potential will increase in magnitude as elements are added to the limit prescribed by the materials. As a consequence of this action, these integrated magnetic elements will do more work, since the effect is cumulative.

Incorporation of such integrated magnetic elements into structures designed to rotate, for instance, will result in a more useful device, since it will do more useful work.

The integrated magnetic elements of the invention comprise individual elements physically joined together by fusion. If fusion is employed, the temperature employed will be at or near the melting point and hence above the Curie temperature of the individual elements. Cooling in a magnetic field as the temperature is reduced through the Curie temperature will ensure that the magnetic properties of the junction lost by heating are restored.

As an example as to how the integrated magnetic element of the invention may be constructed, the following Table of magnetic properties contains information which will be referred to subsequently. This information is based on curves taken from FIG. 17 of

TABLE

Magnetic Properties of Selected Materials

| Code | Material | K-Gauss | μ, Henry/m, $10^{-3}$ | $B_r$ K-Gauss | $\mu_r$ |
|---|---|---|---|---|---|
| 4 | ingot iron | 3.8 | 3.76 | 3.0 | 2992 |
| 32 | Mumetal | 6.0 | 6.28 | 5.0 | 4997 |
| 16 | Remalloy | 9.0 | | | |
| 29 | 78 Permalloy | 9.0 | 10. | 8.0 | 7957 |
| 22 | 4750 | 12.5 | 13.8 | 11.0 | 10,981 |

the *Metals Handbook*, Vol. 1, published by the American Society of Metals, page 792. The remanent point ($B_r$) is taken at a magnization force of 1.0 oersted.

An integrated magnetic element of the invention may be constructed comprising the five above-listed materials in ascending order of permeability:

4-32-16-29-22

In relation to FIG. 2, 14*a* is #4, 14*b* is #32 etc. This combination results in the curve shown in FIG. 6, which plots the permeabilities in Henrys against the remanent flux in kilogauss. By combining the elements as shown, the permeance of these elements and their respective forces are integrated. The resultant of the foregoing represents a total force of attraction or repulsion (within the limits prescribed by the selected materials).

The integrated magnetic element of the invention will have a flux density at the output of the final element which is equal to the ratio of the permeabilities of element 1 to element 5 times the flux density in element No. 1. In order to account for non-linearity, there may be required a constant (k) to scale the equation within the limits of the homogeneous materials. Expressed mathematically, $$k(\mu_1/\mu_5)B_{z1}=B_{z5}$$

Such a constant would probably have a ranging value of less than 1 and in any case would be function of the domains in the affected materials as well as the specific mineral content and isotropic character thereof.

The integration of these materials into a magnetic element should always be construed to give the characteristic desired. For example, for faster switching, a high μ is desired. For other applications, a lower μ is desired.

In order to maximize the magnetic potential of the integrated magnetic element of the invention, each of the elements should be arranged such that there is wide dispersion between the permeabilities of the first and the last element. Thus, a better arrangement than simply arranging it in order of ascending permeabilities would be to combine as follows (in the order 14*a*–14*b*–14*c*–14*d*–14*e*):

32-29-16-4-22.

This is arranged such that permeability increases from left to right in the integrated magnetic element.

As indicated above, the energy stored in a magnet is given by the simple equation $$W_m=(\tfrac{1}{2})(B^2/\mu) \text{ in joules}/m^3.$$

It is not a function of length but only of the flux density in the material and the permeability of that material. Integration of more than one type of material (say, five types) into a fused mass would have the following mathematical effect:

$$W_{mi}=(\tfrac{1}{2})(B_i^2/\mu_i)$$

Summing these terms we have:

$$\sum_{n=1}^{n=5} W_m = \tfrac{1}{2}\left(\frac{B_1^2}{\mu_1}+\frac{B_2^2}{\mu_2}+\frac{B_3^2}{\mu_3}+\frac{B_4^2}{\mu_4}-\frac{B_5^2}{\mu_5}\right)$$

which may be rewritten as:

$$\sum_{n=1}^{n=5} W_m = (\tfrac{1}{2})(\mu_1H_1^2+\mu_2H_2^2+\mu_3H_3^2+\mu_4H_4^2+\mu_5H_5^2)$$

and in the integrated magnetic element, the ampere turns of each segment is the same and thus the previous equation may be rewritten to state the following:

$$\sum_{n=1}^{n=5} W_m = (\tfrac{1}{2})H_1^2(\mu_1+\mu_2+\mu_3+\mu_4+\mu_5)$$

This equation clearly demonstrates that the more elements added to the integrated magnetic element, the more the energy will be increased that is contained within it by virtue of the fact that it has been subjected to an arbitrary magnetomotive force.

It will be recalled that:

$$k(\mu_1B_1)=\mu_5B_5$$

It is obvious that the force exerted at the end of the integrated magnetic element which has the greater flux is greater in magnitude than the end of the integrated magnetic device which has the lesser flux, since $B_5$ is greater than $B_1$ in this illustration and this magnetic element device has more energy contained within it according to the design as discussed above.

By definition, the force exerted by a magnet is stated by the following equation:

$$F=B^2A/2\mu_o \text{ (newtons)}$$

$$F_1=B_1^2A_1/2\mu_o;$$

$$F_5=B_5^2A_5/2\mu_o$$

Dealing now with the integrated section as shown above:

32-29-16-4-22, energy and amplified force have been integrated within the prescribed limits of the chosen materials.

$$F_{22} = B_{22}^2A_{22}/2\mu_o$$
$$= (11{,}000)^2(A_{22})/2(u_o)$$

Assuming an area of 1 $cm^2$, $F_{22}=48$ newtons, while $F_{32}=9.9$ newtons.

Such an integrated magnetic element of the invention clearly demonstrates a differential force; that is, $$F_{22}>F_{32}$$

These forces are called attractive or repulsive forces in the gap between the poles. Incorporation of the integrated magnetic element into a device which would rotate would result in work, using an unbalanced system as depicted FIG. 7. Assuring that unit pole strength is defined as unit magnetic element strength=1, with two units=2, etc., and constructing the device so that all poles oppose each other, no matter what the position of the rotor 20 is with respect to the stator 22, there will always be a greater number of forcing functions on the stator behind the rotor functions than in front of it.

These rotary devices are placed here to show that this element can be used to propel a shaft and that if they are carefully made and balanced, the rotary devices will not show decay.

Figure 8:
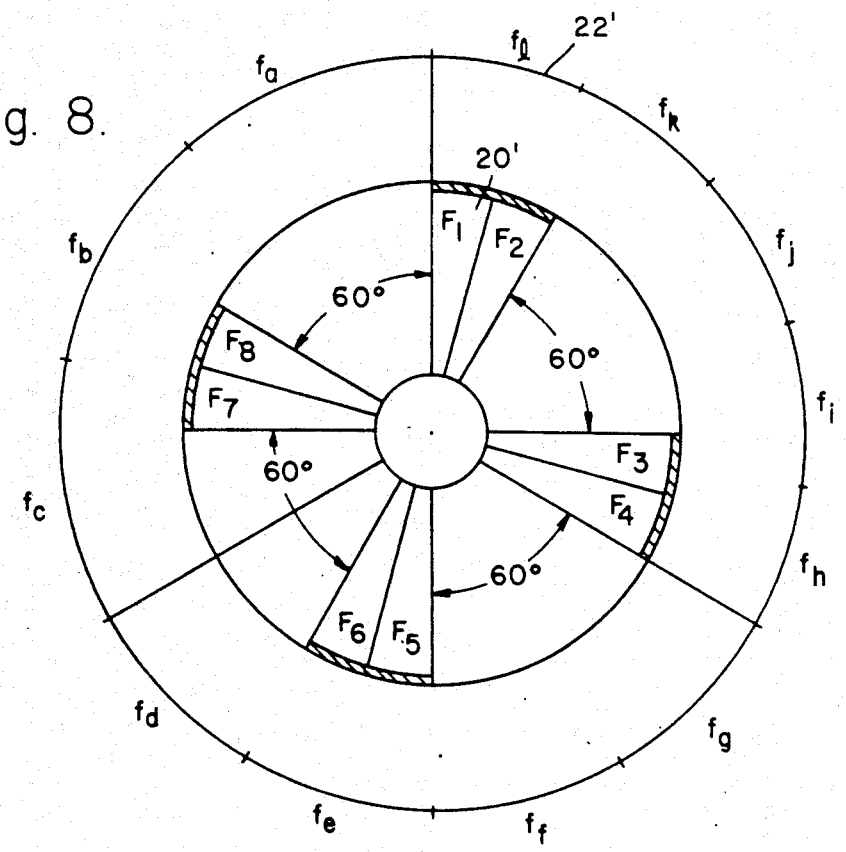
FIG. 8 is a schematic view, similar to that of FIG. 7, depicting in greater detail a rotor-stator combination.

Recalling $F=B^2A/2\mu_o$, all forces are wound as unit forces proportional to area; that is to say, referring to FIG. 8, if ($f_a$) on stator 22' has a greater area than ($F_1$) on rotor 20' because ($f_a$) spans 60°, looking at the interrelationship between $f_a$ and $F_1$, since the area of a cylinder=($\pi r_1^2$) ($\Delta z$) and the area of a second cylinder=($\pi r_2^2$) ($\Delta z$), then $$f_a \simeq \frac{B^2(\pi r_2^2)(\Delta z)}{2\mu_o} \simeq F_1 \simeq \frac{B^2(\pi r_1^2)(\Delta z)}{2\mu_o}$$

Since $f_a$ must be designed substantially equal to $F_1$, using unit poles, $$B_a^2(\pi r_2^2)(\Delta z)=B_1^2(\pi r_1^2)(\Delta z)$$

If $B_A \neq B_1$, then the flux density of force #A must be ($r_1/r_2$) times greater than the flux density of force #1. Each rotor pole will always have a greater force in back of it than in front of it, since force is a function of angle, and forces that are 90° in time away from a pole must manifest themselves in influence on the pole that is moving.

In short, building such a rotating device and carefully balancing its integrated magnetic element with all the others incorporated into the device will cause the rotor to turn and remain in motion. Placing a load on such a rotor would manifest itself in some heat.

It will be recalled that the fabrication of the integrated magnetic element of the invention permits summing the permeabilities of the individual elements. As a consequence, switching in magnetic circuits will be increased over prior art magnets, employing the integrated magnetic element of the invention.

The foregoing arises from the following consideration:

$$\frac{\Delta\phi}{\Delta t} = \frac{\Delta(NI)}{\Delta t} = \frac{\Delta(BA)}{\Delta t} = \frac{\Delta A(\mu H)}{\Delta t} = \frac{\Delta(AH)(\mu)}{\Delta t}$$

where $$\mu = \sum_{n=1}^{n=k} (\mu_1 + \mu_2 + \mu_3 + \ldots + \mu_k).$$

Since the term $$\frac{\Delta(AH)}{\Delta t}\left(\sum_{n=1}^{n=k} \mu_n\right)$$

will increase the slope of the permeability curve, it will in effect increase the switching speed of any device that it is incorporated into.

A large percentage of computer memory circuits use tiny toroidal wafers of ferromagnetic material. The ($\Delta\phi/\Delta t$) term which retains the remanence or voltage is a function of the $$\sum_{n=1}^{n=k} (\mu_n)$$

term. The integrated magnetic elements will, therefore, switch faster than conventional magnetic elements comprising a unitary magnetic material.

Figure 9:
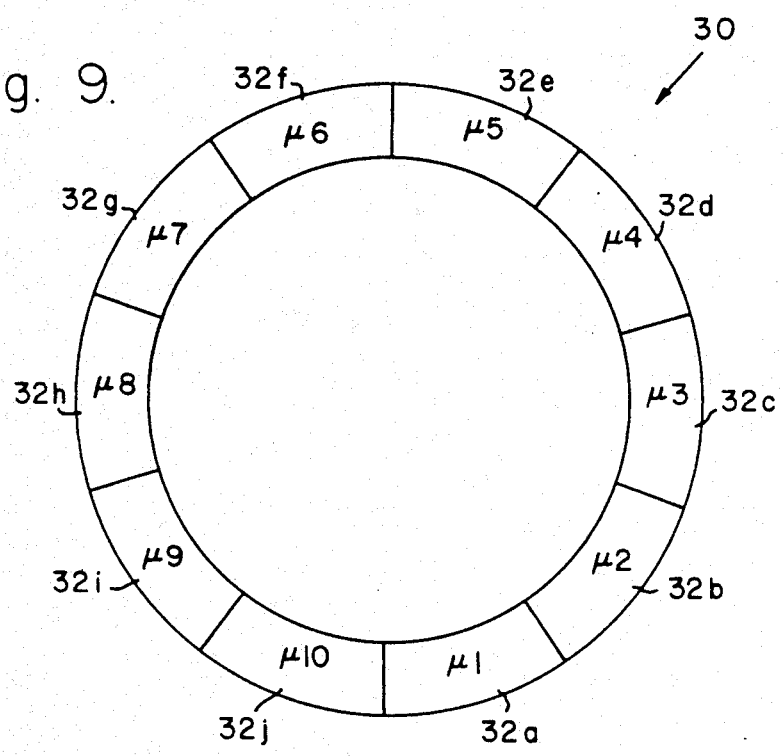
FIG. 9 is a plan view of a magnetic toroid comprising a plurality of discrete magnetic materials of different permeabilities fused together.
Figure 10:
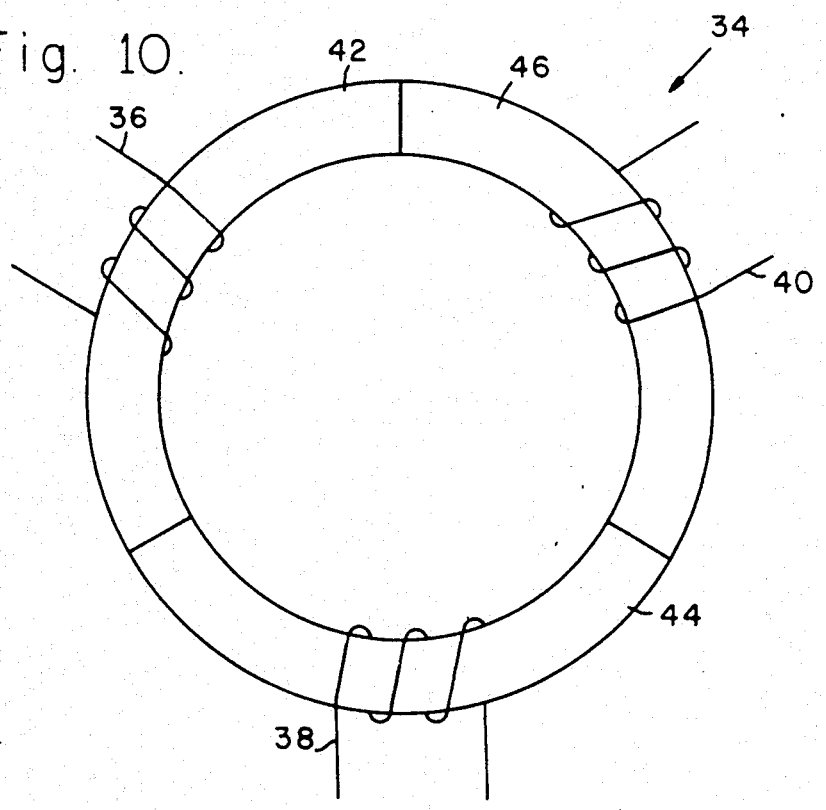
FIG. 10 is a schematic, plan view of a magnetic memory element, depicting a series of windings about each discrete magnetic material.

FIG. 9 depicts a toroid 30 comprising several magnetic elements 32*a–j*, each having a different permeability. FIG. 10 depicts a wound toroid memory element 34 with each series of 36, 38, 40 windings associated with one magnetic element 42, 44, 46, respectively. As above, each series of windings has the same number of turns as the others, to establish an identical (mmf) in each magnetic element.

One example to consider is a laminate of No. 4750 alloy (soft material) and iron (soft material) sandwiching a layer or Remalloy (hard material). Iron will retain a remanent flux if it is fused into an element which contains a hard magnetic material after an applied magnetomotive force. When the applied (mmf) is removed, remnant flux density of the hard magnetic material will remain and since the flux density of the magnetic element cannot fall below the level within the Remalloy, the flux densities within the No. 4750 alloy and the iron cannot fall below that level. Therefore, the integrated resultant magnetic force will remain, i.e.:

$$F_{iron}+F_{4750}+F_{Remalloy}=F_{Total}.$$

The magnetic element will retain this force, holding the current in the element in place. Therefore, the circulating currents, in the magnetic element have increased and the resultant fused magnetic element has more energy contained within it.

The fused element can now be subjected to the steel mill environment for additional rework to improve its properties. No known powdered materials using binders constricted into magnetic states can be subjected to such steel mill, thermal or mechanical forces.

Thus, there has been disclosed a magnetic element device and apparatus for using the same. Various changes and modifications will be obvious to those skilled in the art, and all such changes and modifications not deviating from the spirit and scope of the invention are intended to be covered by the appended claims.

What is claimed is:

1. An integrated magnetic element comprising a plurality of hard and soft magnetic elements of dissimilar permeability; said magnetic elements being initially fused together and subsequent to said fusing being subjected to a singular magnetomotive force defining a resulting energy product for each of said magnetic elements of substantially equal magnitude, each with respect to the other; said plurality of magnetic elements arranged such that there is wide dispersion between the permeabilities of a first and a last of said magnetic elements, and having iron as one of said plurality of magnetic elements; said iron being proximate to one end of said integrated magnetic element, and wherein said integrated magnetic element is binder-free and durable enough to withstand mechanical and thermal forces of reworking said integrated magnetic element.

2. A process for fabricating an integrated magnetic element including the steps of:

(a) assembling a plurality of magnetic elements, each having a predetermined and dissimilar permeability arranged such that there is wide dispersion between said permeability of a first and a last element; said plurality of magnetic elements includes iron arranged proximate one end of said integrated magnetic element;

(b) non-powdered fusing said magnetic elements each to the other at high temperature to form said integrated magnetic element; and (c) subsequent to said fusing step, subjecting each magnetic element to an identical magnetomotive force to induce a substantially equal magnetization in each of said magnetic elements.

3. A process for fabricating an integrated magnetic element which comprises:

(a) assembling at least two magnetic elements of dissimilar materials, each have a preselected size;

(b) fusing said at least two magnetic elements together to form said integrated magnetic elements;

(c) subjecting each magnetic element to an identical magnetomotive force to induce the same magnetization in each element; and (d) reworking said integrated magnetic element by subjecting said integrated magnetic element to mechanical forces to achieve desirable physical characteristics.

* * * * *

UNITED STATES PATENT AND TRADEMARK OFFICE

CERTIFICATE OF CORRECTION

PATENT NO. : 5,047,743

DATED : September 10, 1991

INVENTOR(S) : Stanley P. Scesney

It is certified that error appears in the above-identified patent and that said Letters Patent is hereby corrected as shown below:

Title page: Item (76) inventor's address should read -- P.O. Box 1031--.

Column 2, line 25, delete "such" immediately after "Subjecting".

Column 3, line 39, "Fig.4" should be "Fig. 5".

Column 3, line 44, "Fig. 5" should read "Fig. 4".

Column 5, line 14, substitute "integrating" for "integrated".

Column 5, line 24, substitute "force" for "field".

Column 5, line 29, substitute "Fig. 5" for "Fig. 4".

Signed and Sealed this

Twenty-sixth Day of May, 1992

*Attest:*

*Attesting Officer*

DOUGLAS B. COMER

*Acting Commissioner of Patents and Trademarks*